US005901621A

United States Patent [19]

Chen

[11] Patent Number: 5,901,621

[45] Date of Patent: May 11, 1999

[54] HANGING TOOL AND HANGER SEAT

[76] Inventor: Chin I Chen, 1F., No.2, 525 Lane, 16 Lin, Chong-Cheng Road, Si-Lin Tsuen, Lin-Kou Hsiang, Taipei Hsien, Taiwan

[21] Appl. No.: 09/003,451

[22] Filed: Jan. 6, 1998

[30] Foreign Application Priority Data

Jul. 25, 1997 [TW] Taiwan ..... 86212553

[51] Int. Cl.[6] ..... B25B 13/48

[52] U.S. Cl. ..... 81/436

[58] Field of Search ..... 81/436; 248/339, 248/343

[56] References Cited

U.S. PATENT DOCUMENTS 1,262,300 4/1918 Blake ..... 81/436

FOREIGN PATENT DOCUMENTS 298222 2/1997 Taiwan .
303659 4/1997 Taiwan .

*Primary Examiner*—David A. Scherbel
*Assistant Examiner*—Philip J. Hoffmann
*Attorney, Agent, or Firm*—Thomas Schneck

[57] ABSTRACT

An assembled hanging tool and hanger seat of the invention mainly comprises a hanging tool and a hanger seat. One end of the hanging tool is a hanger portion and the other end of the hanging tool is a hook portion. The hanger seat is substantially of a C shape wherein one side is provided with a hollow element for the threading through of the hanger portion in order to be lifted to a high place, and one end is provided with a projection for being inserted into a C-shaped steel support at a high place, and another end is provided with a threaded hole and a hanging hole wherein the threaded hole is used for engaging with a locking member which can be engaged or disengaged with the C-shaped steel support. One end of the locking member has a turning hole for the threading through of the hook portion in order to rotate and lock, or release the locking member, and the hanging hole is used for hanging or locking the article to be hung.

6 Claims, 5 Drawing Sheets

HANGING TOOL AND HANGER SEAT

BACKGROUND OF THE INVENTION

1. Field of the Invention

The present invention relates to a hanging device, and in particular, to an assembled hanging tool and hanger seat for easily and quickly hanging the hanger seat with an article hung thereon on a high place and locking the same by means of the hanging tool.

2. Description of the Prior Art

It usually happens in our daily life to hang an article on a hanger seat and then to fix the hanger seat at a certain place in order to hang the article smoothly. For example, R.O.C. (Taiwan) Utility Model Publication No.298222 "An improved stricture of a hanger seat" and R.O.C. (Taiwan) Utility Model Publication No.303659 "Assembled hanger structure" disclose two kinds of hanger seats.

Such known hanger seats are convenient in hanging an article on a place of which the height can be easily reached by people, but if the article needs to be hung on a high place of which the height is, for example, of about 4 m or more, then people have to use a ladder and have to climb the ladder in order to hang the hanger seat (with an article hung thereon) on an appropriate place. The implementing manner of such a known hanger seat is not only time-consuming, but also dangerous, and it is also inconvenient, time-consuming and dangerous if wanting to discharge the hung article.

Therefore, how to hang an article on a high place effectively, quickly and conveniently is a problem difficult to be solved.

BRIEF SUMMARY OF THE INVENTION

The assembled hanging tool and hanger seat of the invention mainly comprises a hanging tool and a hanger seat. One end of the hanging tool is a hanger portion and the other end of the hanging tool is a hook portion. The hanger seat is substantially of a C shape wherein one side is provided with a hollow element for the threading through of the hanger portion in order to be lifted to a high place, and one end is provided with a projection for being inserted into a steel support with C-shaped cross-section (C-shaped steel support) at a high place, and another end is provided with a threaded hole and a hanging hole wherein the threaded hole is used for engaging with a locking member which can be engaged or disengaged with the C-shaped steel support. One end of the locking member has a turning hole for the threading through of the hook portion in order to rotate and lock, or release the locking member, and the hanging hole is used for hanging or locking the article to be hung.

PURPOSE OF THE INVENTION

Accordingly, it is an object of the present invention to provide an assembled hanging tool and hanger seat, which is easily to use without a ladder in order to hang an article on a high place.

It is another object of the present invention to provide an assembled hanging tool and hanger seat, which can substantially save the time for hanging the article on a high place and also can quickly and effectively discharge the hung article at a high place when compared with the prior art. If using a working chair, it can hang an article on a higher place.

BRIEF DESCRIPTION OF THE DRAWINGS

These and other attributes of the present invention will be understood clearly upon a thorough study of the following description of the preferred embodiments for carrying out the invention, particularly referring to the accompanying drawings, wherein.

DETAILED DESCRIPTION OF THE INVENTION

Please refer to FIG. 1 to FIG. 6.

Figure 1:
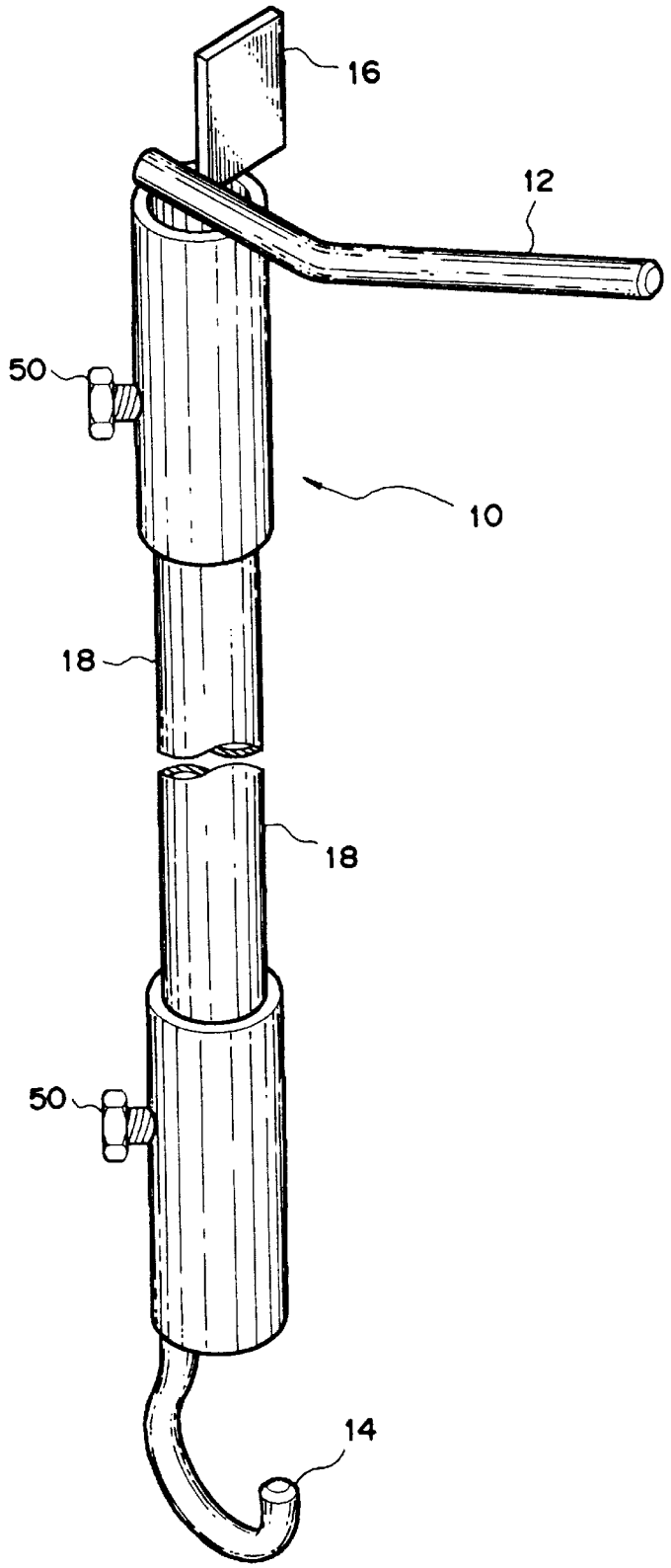
FIG. 1 is a perspective view of a hanging tool in accordance with the present invention.
Figure 2:
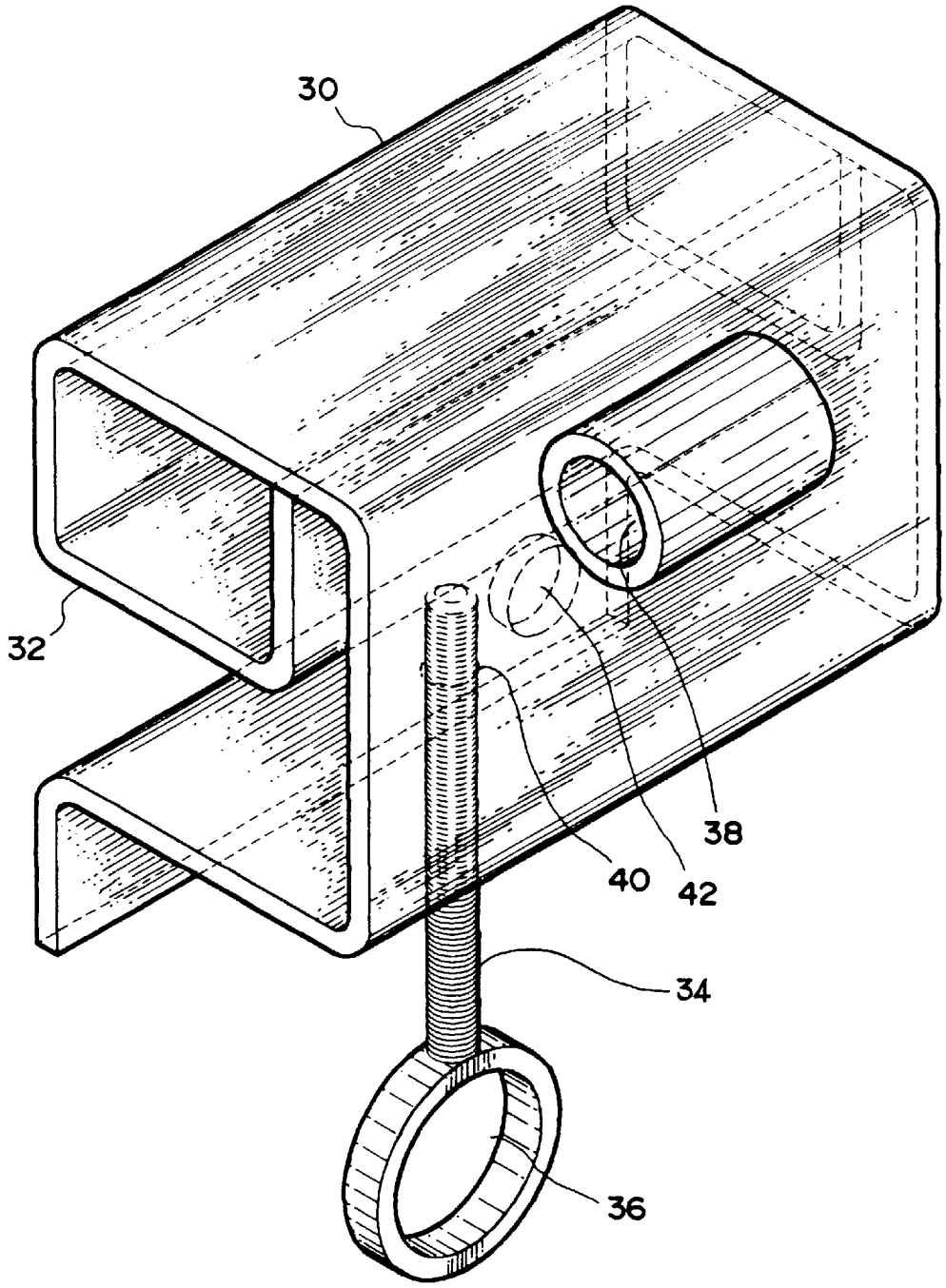
FIG. 2 is a perspective view of a hanger seat in accordance with the present invention.

The assembled hanging tool and hanger seat of the present invention mainly comprises a hanging tool 10 and a hanger seat 30 as shown in FIG. 1 and FIG. 2. The hanging tool 10 has a rod portion 18, a hanger portion 12 being fixed at one end of the rod portion 18 by means of a fastener member 50, and a hook portion 14 being fixed at another end of the rod portion 18 by means of a fastener member 50 (as shown in FIG. 1). The hanger seat 30 is substantially of a C shape wherein one side of the hanger seat 30 is provided with a hollow element 38 for the threading through (not shown in the drawing) of the hanger portion 12, and one end of the hanger seat 30 has a threaded hole 40 and a hanging hole 42, the threaded hole 40 being engaged or disengaged with a locking member, such as an adjustment screw 34 of which one end is provided with a turning hole 36 for the threading through of the hook portion 14 (as shown in FIG. 3).

Figure 3:
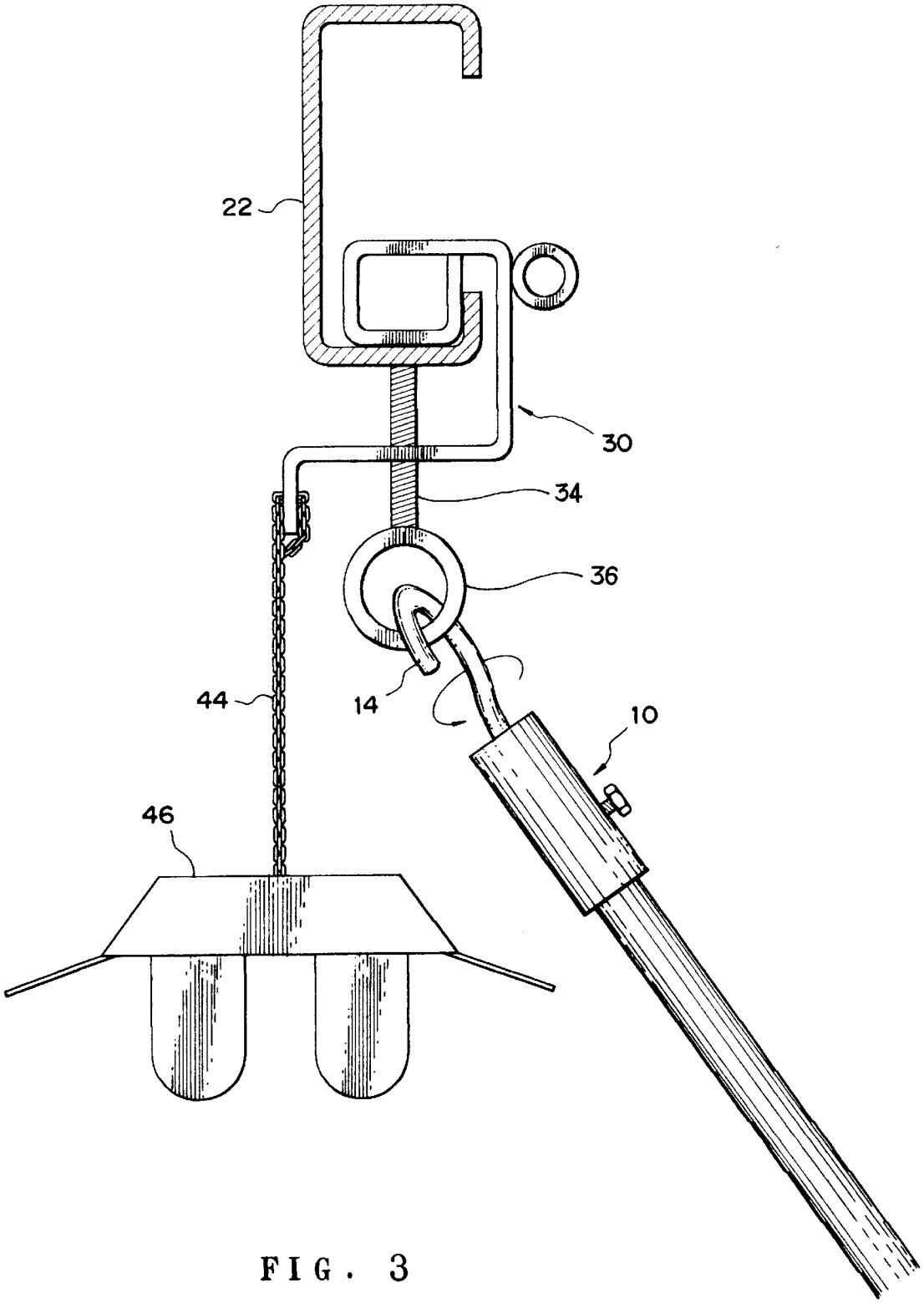
FIG. 3 is a side view showing hanging the hanger seat and a lamp by using the hanging tool of the present invention.

When in use, the hanger portion 12 of the hanging tool 10 is threaded through (not shown in the drawing) the hollow element 38 in order to mount the hanger seat 30 on to a C-shaped steel support 22 or an L-shaped steel support and the projection 22 will be inserted into the steel support 22, then the hook portion 14 is threaded through the turning hole 36 in order to lock the locking member and hang the hanger seat 30 and the article (such as a lamp 46), which has been hung on the hanging hole 42 by means of a rope 44 or hanging rod or the like, on the steel support 22 as shown in FIG. 3, and the lamp can be discharged in a reverse manner.

In addition, a plurality of hanger seats 30 can be used for hanging a plurality of articles, but only a hanging tool 10 is needed for said plurality of hanger seats 30.

Figure 4:
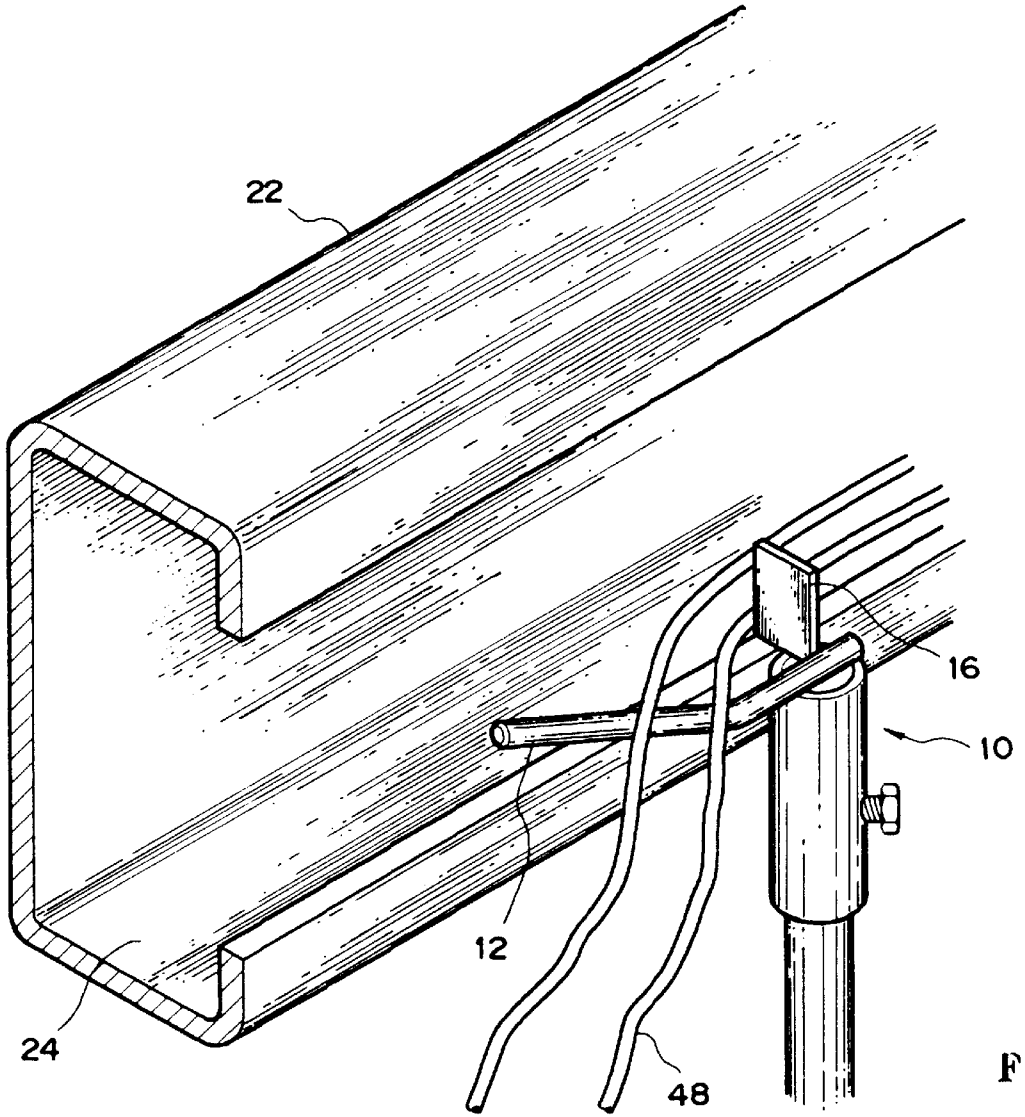
FIG. 4 is a schematic view showing the hanger portion of the hanging tool of the present invention hooking cables.

The end of the hanger portion 12 of the hanging tool 10 can be provided with a stop member 16 such that cable 48 (for example, the wire of the lamp 46) can be first hung between the hanger portion 12 and the stop member 16, and then be moved along the length direction of the steel support 22, and finally be hidden in a groove 24 of the steel support 22 as shown in FIG. 4.

Generally speaking, if the rod portion 18 of the hanging tool 10 is about 3 m, then it is possible to hang the article on a place of which the height is more than 4 m by utilizing the height of the user and the length of the user's hand and without the help of a ladder.

Figure 5:
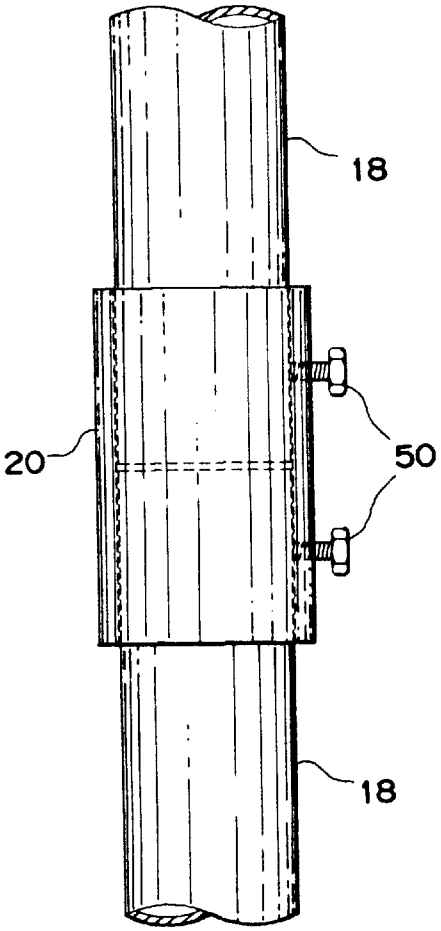
FIG. 5 is a schematic view showing the assembled rods of the hanging tool of the present invention.

Further, the length of the rod portion 18 can be adjusted by connecting a plurality of rods 18; that is, to insert into two ends of a connecting sleeve 20 respectively one end of a rod and fix the rods by means of fastener members 50 as shown in FIG. 5. Therefore, if wanting to use the rod portion 18 having the height of 4 m in order to hang an article on a place of about 5 m in height, since a rod portion 18 of 4 m may be too long and not easy to transport, then the user can assemble two rods of 2 m in length. If using a working chair of 2.5 m in height, then we can hang the article on a place of about 7 m in height.

Figure 6:
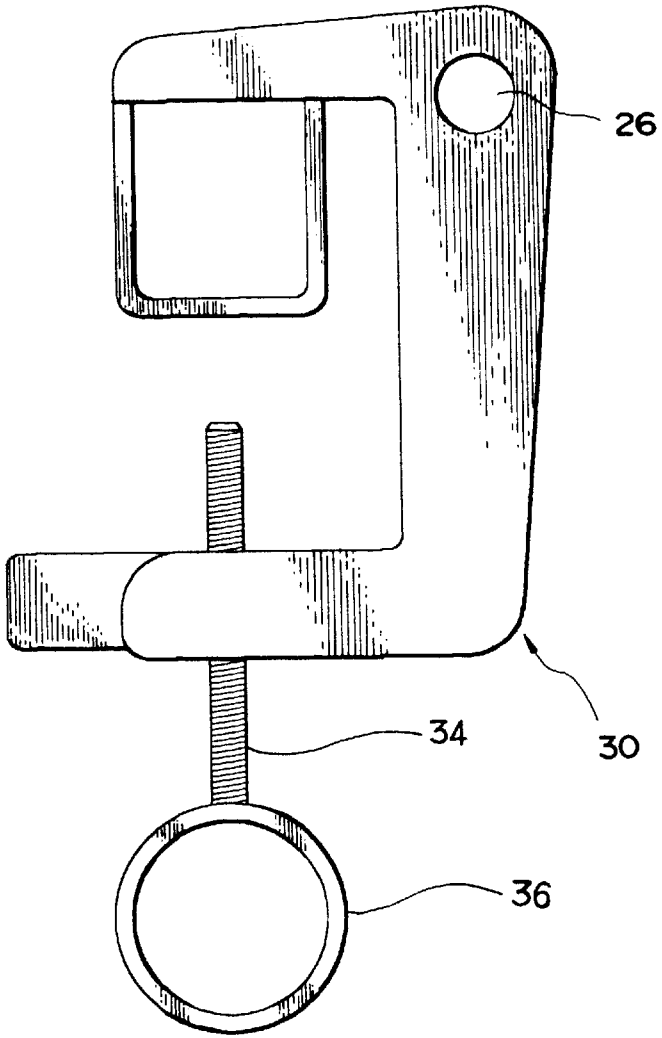
FIG. 6 is a side view of another embodiment of the hanging tool of the present invention.

Further, the hollow element 38 also can many variations. For example, if the thickness of the side of the hanger seat 30 on which the hollow element 38 is provided is thicker, then the hollow element 38 can be replaced by a hole 26 as shown in FIG. 6.

DESCRIPTION OF THE REFERENCE NUMERALS

| | |
|---|---|
| 10 | hanging tool |
| 12 | hanger portion |
| 14 | hook portion |
| 16 | stop member |
| 18 | rod portion |
| 20 | connecting sleeve |
| 22 | C-shaped steel support |
| 24 | groove |
| 26 | hole (having the same function as the hollow element 38) |
| 30 | hanger seat |
| 32 | projection |
| 34 | adjustment screw |
| 36 | turning hole |
| 38 | hollow element |
| 40 | threaded hole |
| 42 | hanging hole |
| 44 | rope |
| 46 | lamp |
| 48 | cable |
| 50 | fastener member |

I claim:

1. An assembled hanging tool and hanger seat, comprising:

a hanging tool having a rod portion, a hanger portion being fixed at one end of the rod portion by means of a fastener member, and a hook portion being fixed at another end of the rod portion by means of a fastener member; and a hanger seat being substantially of a C shape wherein one side of the hanger seat is provided with a hollow element for the threading through of the hanger portion, and one end of the hanger seat has a projection and another end of the hanger seat has a threaded hole and a hanging hole, the threaded hole being engaged or disengaged with a locking member of which one end is provided with a turning hole for the threading through of the hook portion;

whereby the hanger portion of the hanging tool can be threaded through the hollow element in order to mount the hanger seat on to a C-shaped steel support or an L-shaped steel support and the projection will be inserted into the steel support, then the hook portion is threaded through the turning hole in order to lock the locking member and hang the hanger seat and an article, which has been hung on the hanging hole, on the steel support, and the hung article can be discharged in a reverse manner.

2. An assembled hanging tool and hanger seat as claimed in claim 1, wherein said locking member is an adjustment screw.

3. An assembled hanging tool and hanger seat as claimed in claim 1, wherein said rod portion is composed of a plurality of rods connected together; that is, to insert into two ends of a connecting sleeve respectively one end of a rod and said rods are fixed by means of fastener members.

4. An assembled hanging tool and hanger seat as claimed in claim 1, wherein said article is a lamp.

5. An assembled hanging tool and hanger seat as claimed in claim 4, wherein said lamp is hung on the hanging hole by means of a rope and a hanging rod.

6. An assembled hanging tool and hanger seat as claimed in claim 1, wherein the end of said hanger portion of said hanging tool is provided with a stop member such that cables can be first hung between said hanger portion and said stop member, and then be moved along the length direction of the steel support, and finally be hidden in a groove of the steel support.

* * * * *